US007794530B2

(12) United States Patent
Vaskelis et al.

(10) Patent No.: US 7,794,530 B2
(45) Date of Patent: Sep. 14, 2010

(54) ELECTROLESS DEPOSITION OF COBALT ALLOYS

(75) Inventors: Algirdas Vaskelis, Vilnius (LT); Aldona Jagminiene, Vilnius (LT); Ina Stankeviciene, Vilnius (LT); Eugenijus Norkus, Vilnius (LT)

(73) Assignee: Lam Research Corporation, Fremont, CA (US)

( * ) Notice: Subject to any disclaimer, the term of this patent is extended or adjusted under 35 U.S.C. 154(b) by 901 days.

(21) Appl. No.: 11/644,697

(22) Filed: Dec. 22, 2006

(65) Prior Publication Data

US 2008/0152822 A1 Jun. 26, 2008

(51) Int. Cl.
*C23C 18/32* (2006.01)
*C23C 18/34* (2006.01)

(52) U.S. Cl. ..... 106/1.27; 106/1.22

(58) Field of Classification Search ..... 106/1.27, 106/1.22

See application file for complete search history.

(56) References Cited

U.S. PATENT DOCUMENTS

| | | | | |
|---|---|---|---|---|
| 3,900,599 | A | 8/1975 | Feldstein et al. | |
| 5,614,003 | A * | 3/1997 | Mallory, Jr. | 106/1.22 |
| 5,858,073 | A * | 1/1999 | Hine et al. | 106/1.22 |
| 6,060,181 | A * | 5/2000 | Stolk | 428/836.1 |
| 6,528,184 | B2 | 3/2003 | Man et al. | |
| 6,797,312 | B2 * | 9/2004 | Kong et al. | 427/58 |
| 6,824,612 | B2 | 11/2004 | Stevens et al. | |
| 6,864,181 | B2 | 3/2005 | Redeker et al. | |
| 7,297,190 | B1 | 11/2007 | Dordi et al. | |
| 7,306,662 | B2 | 12/2007 | Vaskelis et al. | |
| 7,332,193 | B2 * | 2/2008 | Valverde et al. | 427/99.5 |
| 7,407,689 | B2 * | 8/2008 | Joshi et al. | 427/309 |
| 7,611,987 | B2 * | 11/2009 | Chen et al. | 438/678 |
| 7,615,491 | B2 * | 11/2009 | Chen et al. | 438/678 |
| 2002/0152955 | A1 | 10/2002 | Dordi et al. | |
| 2004/0185683 | A1 * | 9/2004 | Nakamura | 438/957 |
| 2005/0136193 | A1 * | 6/2005 | Weidman et al. | 106/1.27 |
| 2005/0208760 | A1 | 9/2005 | Ryan | |
| 2005/0241763 | A1 | 11/2005 | Huang et al. | |

(Continued)

FOREIGN PATENT DOCUMENTS

WO WO-2005038085 A2 4/2005

(Continued)

OTHER PUBLICATIONS

Kondoh et al., "Deposition of Ru Thin Films from Supercritical Carbon Dioxide Fluids", J.J. Appl. Phys. 44(7B) p. 5799-5802 (2005).

(Continued)

*Primary Examiner*—Helene Klemanski
(74) *Attorney, Agent, or Firm*—Schwegman, Lundberg & Woessner, P.A.

(57) ABSTRACT

Systems and methods for electroless deposition of a cobalt-alloy layer on a copper surface include a solution characterized by a low pH. This solution may include, for example, a cobalt(II) salt, a complexing agent including at least two amine groups, a pH adjuster configured to adjust the pH to below 7.0, and a reducing agent. In some embodiments, the cobalt-alloy is configured to facilitate bonding and copper diffusion characteristics between the copper surface and a dielectric in an integrated circuit.

13 Claims, 2 Drawing Sheets

U.S. PATENT DOCUMENTS

| | | | |
|---|---|---|---|
| 2005/0284748 | A1 | 12/2005 | Dordi et al. |
| 2005/0284767 | A1 | 12/2005 | Dordi et al. |
| 2006/0108320 | A1 | 5/2006 | Lazovsky et al. |
| 2006/0134917 | A1 | 6/2006 | Huang et al. |
| 2007/0048447 | A1 | 3/2007 | Lee et al. |
| 2007/0261594 | A1 | 11/2007 | Vaskelis et al. |
| 2007/0264830 | A1 | 11/2007 | Huang et al. |
| 2007/0292603 | A1 | 12/2007 | Dordi et al. |
| 2007/0292604 | A1 | 12/2007 | Dordi et al. |
| 2007/0292615 | A1 | 12/2007 | Dordi et al. |

FOREIGN PATENT DOCUMENTS

| | | | |
|---|---|---|---|
| WO | WO-2006044990 | A1 | 4/2006 |
| WO | WO-2008085256 | A2 | 7/2008 |
| WO | WO-2008085256 | A3 | 7/2008 |

OTHER PUBLICATIONS

"International Application Serial No. PCT/US2007/025460, International Search Report mailed Oct. 15, 2008" 3 pgs.

"International Application Serial No. PCT/US2007/025460, International Written Opinion mailed Oct. 15, 2008" 4 pgs.

Kohn, et al., "Characterization of electroless deposited Co (W,P) thin films for encapsulation of copper metallization", *Materials Science and Engineering*. vol. 302, Issue 1,, avail. online Feb. 5, 2001, (Apr. 15, 2001), pp. 18-25.

* cited by examiner

ELECTROLESS DEPOSITION OF COBALT ALLOYS

BACKGROUND

1. Field of the Invention

The invention is in the field of semiconductor manufacturing and more specifically in the field of manufacturing multilayer structures that include copper.

2. Related Art

Dielectric barrier layers including Cu—SiC or Cu—$Si_3N_4$ are commonly used in semiconductor devices. For example, these dielectric barrier layers may be incorporated within advanced back-end-of-line (BEOL) metallization structures. It has been found that the inclusion of a cobalt-alloy capping layer deposited between the copper layer and the SiC or $Si_3N_4$ layer results in improved adhesion between the layers and improved electro-migration and copper diffusion characteristics. The cobalt-alloy capping layer can be deposited on copper by chemical vapor deposition (CVD) or by electroless deposition.

Electroless deposition of cobalt alloys such as CoWBP or CoWP on copper has been demonstrated. A typical approach is to use a cobalt salt, a tungsten salt, a hypophosphite reducing agent, a borane reducing agent such as DMAB (dimethylaminoborane), and a complexing agent in a highly alkaline environment. For example, deposition usually occurs around a pH of 9 or above. When the cobalt alloy is to be used for adhesion improvement purposes only, the tungsten and phosphorus may be unnecessary as these elements are included principally to improve resistance to copper diffusion by stuffing the Co grain boundaries and reducing or eliminating Cu diffusion paths.

Electroless deposition can be inhibited by the presence of a thin copper-oxide layer on the copper. This copper-oxide layer forms when the copper is exposed to air or other oxidizing environment. Further, contaminants on the copper and dielectric surfaces can cause pattern-dependent plating effects such as pattern-dependent variations in the thickness of the cobalt-alloy capping layer. There is, therefore, a need to limit the formation of native copper oxide on the copper layer prior to deposition of the cobalt-alloy capping layer. Typically, the processing environment is controlled to limit this oxide formation, and also to remove any copper oxide and organic contaminants already on the copper surface. Unfortunately, the use of highly alkaline solutions in the electroless deposition of cobalt alloys, as in the prior art, promotes rather than limits the formation of copper oxides.

SUMMARY

Various embodiments of the invention include the use of a low pH, e.g. less than 7, formulation for the deposition of a cobalt alloy on copper. These formulations comprise, for example, a cobalt salt, a nitrogen containing complexing agent, a pH adjuster, an optional grain boundary stuffer, and an optional reducing agent.

Typically, the use of a low pH formulation results in a reduction in copper oxide formation prior to cobalt deposition. The reduction of OH-terminated dielectric surface area may result in improved grain morphology because fewer —OH groups result in a more uniform grain structure as seen by the deposited metal. The deposited metal is able to more directly interact with the copper surface. As such, the morphology of the deposition becomes less sensitive to factors such as deposition rate, DMAB concentration, temperature, and solution concentrations. Further, in some embodiments, the use of a low pH formulation eliminates a need for surface activation using a catalytic metal such as palladium (Pd).

In various embodiments, use of the invention results in integrated circuits having improved adhesion between copper and dielectric barrier layers, improved advanced back-end-of-line (BEOL) metallization structures, and/or improved electro-migration performance, as compared with circuits of the prior art.

Various embodiments of the invention include a solution comprising a cobalt salt, a complexing agent configured to deposit a cobalt layer on copper using the cobalt salt, and a pH adjuster configured to adjust a pH of the solution to below 7.0.

Various embodiments of the invention include a method comprising preparing a solution configured to deposit a cobalt layer on copper, having a pH below 7.0 and comprising a cobalt(II) salt, a complexing agent including at least two amine groups, and a pH adjuster configured to adjust the pH to below 7.0; immersing a copper surface into the solution, and depositing a cobalt-alloy layer on the copper surface using the solution.

Various embodiments of the invention include a semiconducting device manufactured using the method disclosed herein.

DETAILED DESCRIPTION

Figure 1:
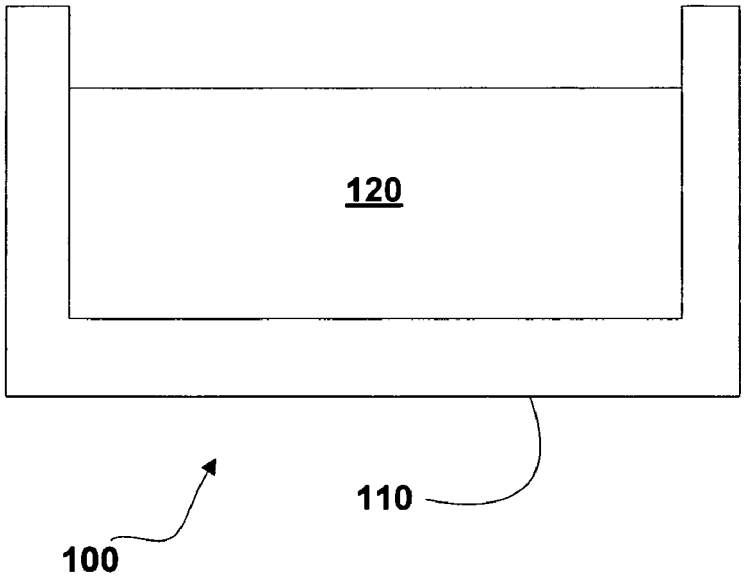
FIG. 1 illustrates an electroless deposition system, according to various embodiments.

FIG. 1 illustrates an electroless deposition system, generally designated 100, according to various embodiments. This system comprises a Container 110 configured to hold a Solution 120. Container 110 is optionally configured to maintain Solution 120 at reaction temperatures between 0 and 100° C., and in one embodiment between approximately 40 and 70° C.

Solution 120 is configured for deposition of cobalt-alloys on a copper substrate. In various embodiments, these cobalt-alloys comprise cobalt-tungsten phosphorus alloy (CoWP), cobalt-tungsten-boron alloy (CoWB), cobalt-tungsten-boron-phosphorus alloy, and/or the like. In various embodiments, these cobalt-alloys are configured to improve adhesion and/or copper diffusion barrier characteristics between copper and a dielectric layer such as SiC or $Si_3N_4$.

Solution 120 is characterized by a pH less than 9. For example, in various embodiments, Solution 120 has a pH less than 7.5, 7, 6.5, 6, 5.5 or 5.0.

Solution 120 comprises a cobalt salt. This cobalt salt may comprise cobalt(II), for example $CoSO_4$, $Co(NO_3)_2$, or the like. This cobalt salt may comprise a complex salt, such as $[Co(II)[amine]_{from\ 1\ to\ 3}]^{2+}[anion(s)]^{2-}$, e.g., $[Co(En)]SO_4$, $[Co(En)_2]SO_4$, $[Co(En)_3]SO_4$, $[Co(Dien)](NO_3)_2$, $[Co(Dien)_2](NO_3)_2$, or the like, where En is ethyenediamine and Dien is diethylenetriamine. The cobalt salt may be included in a wide range of concentrations. In one embodiment, the concentration is $1\times10^{-4}$ M or less.

Solution 120 further comprises a complexing agent. Typically, the complexing agent comprises an amine group, however, ammonia and other simple organic amines and polyamines may be substituted in alternative embodiments. For example, the complexing agent may comprise ammonia, $NH_4OH$, or diamine and tri-amine compounds. In various embodiments, the complexing agent comprises ethylenediamine, propylenediamine, diethylenetriamine, 3-methylenediamine, triethylenetetraamine, tetraethylenepentamine, higher aliphatic polyamines, and/or other polyamines. In various embodiments, the polyamines comprise tetra-amines, penta-amines, cyclic diamines and/or tri-amines. These may be of the general form R"—NH—R'—R—NH—R''' or R"—NH—R'—NH—R—NH—R''' or, more generally, R'''—NH—$[R'—NH]_n$—$[R'—NH]_m$—R—NH—R''''.

In various embodiments, the complexing agent comprises aromatic polyamines such as benzene-1,2-diamine, and nitrogen heterocycles such as pyridine, dipyridine, and nitrogen hetrocyclic amines, and/or polyamines such as pyridine-1-amine. In some embodiments, the amine is protonized in acidic media to form an amine salt. While the concentration of the complexing agent can vary widely, in some embodiments, the concentration is selected to optimize cobalt deposition and film characteristics. The concentration of the complexing agent is typically greater than that of the cation of the cobalt salt.

Solution 120 further comprises a pH adjustor. The pH adjustor may comprise, for example, acetic acid, sulfuric acid, nitric acid or other inorganic or organic acids depending on the anion required. In some embodiments, the pH adjustor comprises a buffer. The concentration of the pH adjustor is typically selected to achieve a desired pH of Solution 120, such as a pH of less than 7.5, 7, 6.5, 6, 5.5 or 5.0.

Solution 120 optionally further comprises a grain boundary stuffer. This grain boundary stuffer may comprise, for example, a tungstate ($WO_4^{-2}$) salt. Alternative or additional grain boundary stuffers can also include phosphorus-based compounds, but others will be apparent to those of ordinary skill in the art.

Solution 120 further comprises an activator or a reducing agent such as DMAB. The activator is configured to activate the copper surface prior to deposition. Other activators include other aminoboranes, such as $NaBH_4$. Others types of aminoboranes that may be included as reducing agents will be apparent to those of ordinary skill in the art.

In various embodiments, Solution 120 may further comprise additives selected to optimize Solution 120 for application specific performance. These optional additives may comprise nucleation enhancement additives configured to produce grain growth of reduced size, nodule growth suppressors, surfactants, stabilizers, and/or the like.

In one embodiment, Solution 120 comprises $CoSO_4$ at a concentration between 0.01M to 0.05M, Dien at concentration of approximately 0.015M; DMAB at a concentration between 0.1M and 0.4M; and $CH_3COOH$ so as to adjust the pH to approximately 5.5.

Solution 120 is optionally prepared using de-oxygenated liquids.

Figure 2:
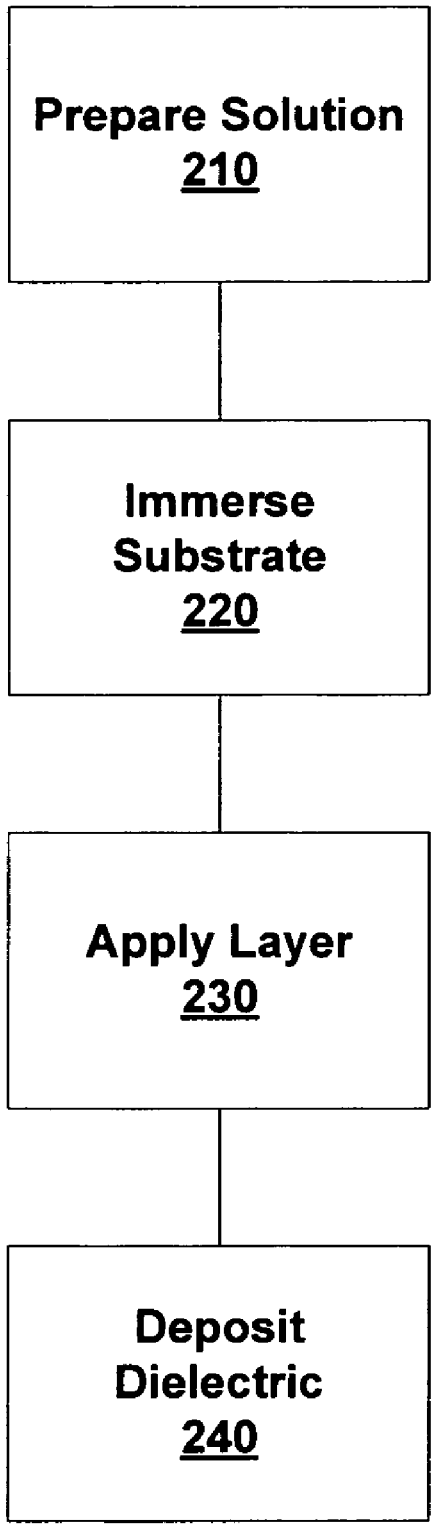
FIG. 2 illustrates a method of depositing a cobalt-alloy layer on a copper layer using the system of FIG. 1, according to various embodiments.

FIG. 2 illustrates a method of depositing a cobalt-alloy layer on a copper layer using the system of FIG. 1, according to various embodiments. In some embodiments, this method is used in the manufacture of integrated circuits.

In Prepare Solution Step 210, Solution 120 is prepared. The preparation may occur in Container 110 or in an external vessel from which Solution 120 is transferred to Container 110.

In an Immerse Substrate Step 220, a copper surface to be coated with a cobalt-alloy is immersed in Solution 120. The copper surface is optionally part of an integrated circuit and/or may be disposed on a semiconductor wafer.

In an Apply Layer Step 230, the cobalt-alloy is deposited on the copper surface through chemical reactions between the copper surface and Solution 120.

In an optional Deposit Dielectric Step 240, a dielectric is deposited on top of the cobalt-alloy. This deposition may be performed in an electroless plating solution, through chemical vapor deposition, and/or the like.

Figure 3:
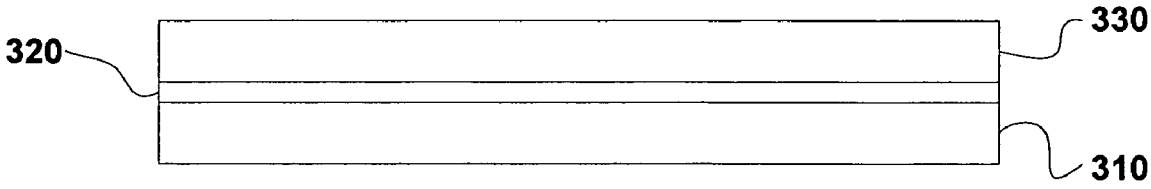
FIG. 3 illustrates a dielectric including a copper layer, a cobalt-alloy layer, and a dielectric barrier layer as may be produced using the method of FIG. 2, according to various embodiments.

FIG. 3 illustrates part of a semiconductor device, e.g., circuit formed on a wafer, including a Copper Layer 310, a Cobalt-Alloy Layer 320, and a Dielectric Barrier Layer 330 as may be produced using the method of FIG. 2, according to various embodiments. The cobalt-alloy Layer 320 is optionally substantially thinner than the Copper Layer 310 and the Dielectric Barrier Layer 330. In some embodiments the circuit is characterized by improved adhesion between the Copper Layer 310 and the Dielectric Barrier Layer 330 and/or reduced Copper diffusion into the Dielectric Barrier Layer 330, relative to circuits of the prior art.

Several embodiments are specifically illustrated and/or described herein. However, it will be appreciated that modifications and variations are covered by the above teachings and within the scope of the appended claims without departing from the spirit and intended scope thereof. For example, while the systems and methods described herein are presented in a context of circuit manufacture, they may be applied to the manufacture of other types of devices. Further, the solutions discussed herein may be aqueous or non-aqueous.

The embodiments discussed herein are illustrative of the present invention. As these embodiments of the present invention are described with reference to illustrations, various modifications or adaptations of the methods and or specific structures described may become apparent to those skilled in the art. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is understood that the present invention is in no way limited to only the embodiments illustrated.

What is claimed is:

1. A solution comprising:

a cobalt salt;

a complexing agent configured to deposit a cobalt layer on copper using the cobalt salt; and a pH adjuster configured to adjust a pH of the solution to below 6.0.

2. The solution of claim 1, further comprising a grain boundary stuffer.

3. The solution of claim 1, further comprising an additive configured to enhance small grain growth, a nodule growth suppressor, or a surfactant.

4. The solution of claim 1, wherein the cobalt salt comprises a cobalt(II) salt.

5. The solution of claim 1, wherein the cobalt salt comprises an amine group.

6. The solution of claim 1, wherein the cobalt salt comprises an amine group in the form $[Co(II)[amine]_{1t\ to\ 3}]^{2+}[anion(s)]^{2-}$.

7. The solution of claim 1, wherein the cobalt salt comprises $\lfloor Co([[En]]ethyenediamine)_2 \rfloor SO_4$, $\lfloor Co([[En]]ethyenediamine)_3 \rfloor SO_4$, $\lfloor Co([[Dien]]diethylenetriamine)) \rfloor (NO_3)_2$, or $\lfloor Co([[Dien]]diethylenetriamine)_2 \rfloor (NO_3)_2$.

8. The solution of claim 1, wherein the complexing agent comprises an amine compound.

9. The solution of claim 8, wherein the amine compound comprises a diamine.

10. The solution of claim 1, wherein the solution is prepared using de-oxygenated liquids.

11. The solution of claim 1, further including a reducing agent.

12. The solution of claim 11, wherein the reducing agent comprises DMAB.

13. The solution of claim 1, wherein the cobalt salt has a concentration of $1\times10^{-4}$ M or less.

* * * * *